US007440549B2

(12) United States Patent
Kerpershoek et al.

(10) Patent No.: US 7,440,549 B2
(45) Date of Patent: Oct. 21, 2008

(54) HEAT PIPE ANODE FOR X-RAY GENERATOR

(75) Inventors: Gijsbertus J. Kerpershoek, Barendrecht (NL); Arjen B. Storm, The Hague (NL); Leendert J. Seijbel, Rotterdam (NL); Franciscus P. M. Vredenbregt, Schipluiden (NL)

(73) Assignee: Bruker AXS Inc., Madison, WI (US)

( * ) Notice: Subject to any disclaimer, the term of this patent is extended or adjusted under 35 U.S.C. 154(b) by 0 days.

(21) Appl. No.: 11/471,960

(22) Filed: Jun. 21, 2006

(65) Prior Publication Data

US 2007/0297570 A1 Dec. 27, 2007

(51) Int. Cl.
*H01J 35/08* (2006.01)

(52) U.S. Cl. ..... 378/130; 378/125

(58) Field of Classification Search ..... 378/119, 378/130, 133, 141, 125, 143
See application file for complete search history.

(56) References Cited

U.S. PATENT DOCUMENTS 4,165,472 A * 8/1979 Wittry ..... 378/130
5,579,364 A * 11/1996 Osaka et al. ..... 378/130
5,737,387 A * 4/1998 Smither ..... 378/130
6,304,631 B1 * 10/2001 Snyder ..... 378/130
2002/0085676 A1 * 7/2002 Snyder ..... 378/130

OTHER PUBLICATIONS

Messenger, R.S., et al., "Novel 'Heat-Pipe' Rotating Anode for X-Ray Lithography", Journal of Vacuum Science Technology, American Vacuum Society, Nov./Dec. 1979, pp. 1946-1948.

* cited by examiner

*Primary Examiner*—Hoon Song
(74) *Attorney, Agent, or Firm*—Law Offices of Paul E. Kudirka

(57) ABSTRACT

A rotating anode for x-ray generation uses a heat pipe principle with a heat pipe coolant located in a sealed chamber of a rotating portion of the anode. The rotating portion is positioned relative to a second portion so that relative rotation occurs between the two portions and so that a fluid path exists between the two portions through which an external cooling fluid may flow. The relative motion between the two portions provides a turbulent flow to the cooling fluid. The anode may also include cooling fins that extend into the sealed chamber. The sealed chamber may be under vacuum, and may be sealed by o-rings or by brazing. A closable fill port may be provided via which heat pipe coolant may be added. A balancing mass may be used to balance the anode in two dimensions.

26 Claims, 6 Drawing Sheets

HEAT PIPE ANODE FOR X-RAY GENERATOR

FIELD OF THE INVENTION

This invention relates generally to the field of x-ray generation and, more particularly, to the generation of high-power x-ray energy.

BACKGROUND OF THE INVENTION

X-ray energy is used in a number of different fields for a variety of purposes, both commercial and experimental. X-rays are often generated by x-ray vacuum tubes, which are evacuated chambers within which a beam of high-energy electrons are directed to a metallic target anode. The interaction of the electrons and the target causes both broad-spectrum bremsstrahlung and characteristic x-rays due to inner electron shell excitation of the anode material.

In certain fields, such as x-ray diffraction, it is the quasi-monochromatic characteristic x-rays that are the useful portion of the x-ray energy emitted from the anode. X-rays of various energies can be generated by selection of an appropriate anode material. For example, anodes of chromium, cobalt, copper or molybdenum are often used.

One problem in the field of x-ray generation is that the process is inherently inefficient, and most of the electron beam energy is dissipated as heat. As the x-ray power is increased (by increasing the power of the electron beam), the temperature of the anode will eventually reach the melting point of the anode material. Once this point is reached, the anode material will rapidly evaporate into the vacuum of the tube, destroying both the anode and the tube. Naturally, this limits the x-ray flux that can be produced by the tube.

The problem with localized heating of anodes in higher-power x-ray generation systems has been addressed by using a rotating anode configuration in which the anode surface rotates rapidly to spread the incident heat load over a larger surface area. As the brightness of a rotating anode x-ray generator is proportional to the power loading on the anode, so it is often desirable to increase this power loading. But the corresponding heat acts as a limit to the brightness achievable, even when using a rotating anode.

A typical, conventional anode is shown in FIG. 1. A thin ring 12 is constructed of a target material, such as copper or molybdenum, which has a desired characteristic x-ray emission in response to electron bombardment. In this example the ring is part of a hollow cup that may be constructed entirely of the characteristic material. The cup is connected to a shaft 11, and together the cup and shaft make up a rotating portion of the anode. The cup/shaft combination is concentric with a stationary distributor, or stator, 13, and between them lays a gap through which a cooling fluid may pass. The fluid may be introduced through an inlet 21 and removed via an outlet 22.

A parameter for the maximum power load of the anode is the shaft speed ω multiplied by the radius R of the cup. Thus, increasing the performance of the generator can be done by increasing the rotation speed ω or by increasing the cup radius R. The cooling of the anode surface takes place by forced fluid convection at the inner diameter of the cup. With the cooling liquid inside, the pressure P on the inside of the anode cup may be represented as:

$$P = \frac{1}{2}\rho_c\omega^2(R_1^2 - R_0^2)$$

where $\rho_c$ is the specific mass of the fluid, $R_1$ is the inner radius of the cup and $R_1-R_0$ is the thickness of the fluid layer. In the case of the conventional anode, $R_0$ will, in most cases, be zero. Typical values with water as a cooling fluid might be:

$$\rho_c=1000\ \text{kg/m}^3;\ \omega=628\ \text{rad/s};\ R_1=0.045\ m;\ R_0=0\ m;\ \text{and } P=4\ \text{bar}$$

The material stresses and sealing problems caused by the internal pressure are a limiting factor for significant improvements in generator performance. Turbulent losses of the cooling liquid in the anode give undesirable high pressure for pumping this fluid through the anode. At the same time, the torque caused by the fluid on the inner diameter of the anode is a significant part of the total driving torque needed to spin the anode.

A "heat pipe" is a well-known heat transfer mechanism. The basic principle behind a heat pipe is based on a closed-cycle fluid phase change, as is demonstrated in FIG. 2. A coolant (A) evaporates at a hot end (i.e., "evaporator section") of the heat pipe. The hot vapor (B) is transported to a cool end (i.e., "condenser section") by buoyancy forces, where it then condenses. The condensed fluid is returned to the hot end by gravity, centripetal forces or capillary action, thereby completing the cycle. Heat pipes, in general, demonstrate extremely efficient thermal transfer with an effective thermal conductivity of up to 10,000 times that of copper.

Rotating anodes for x-ray generators that use a heat pipe principle have been shown in the art. These prior art designs use a coolant fluid in a sealed chamber of the anode that is in thermal contact with a target region to be cooled. The target region is along a periphery of a rotating chamber of the anode, and the fluid is kept in contact with that region via centripetal force. Heat from the target evaporates a portion of the fluid, and the vapor moves toward a rotational axis of the chamber by buoyancy forces. In this inner region is a condensing plate against which the coolant condenses, and is returned to the periphery of the chamber under centripetal force. A cooling fluid flows through a fluid path that is in thermal contact with the condensing plate on the outside of the chamber.

SUMMARY OF THE INVENTION

In accordance with the present invention, a rotating anode for x-ray generation is provided that has a first rotating portion with a target region that emits x-ray radiation in response to an electron beam incident thereupon. A second portion of the anode is positioned so that relative rotation occurs between the first and second portions and so that a fluid path exists between the two portions. A cooling fluid may thus flow between the two portions while being in contact with both. The anode also has a sealed chamber within the rotating portion that is in thermal communication with the target region and also with the fluid path between the two anode portions. A heat pipe coolant is located within the sealed chamber, evaporates in response to heat absorbed from the target region and condenses in response to heat lost to the fluid path.

The location of the cooling fluid path between the first and second anode portions results in the cooling fluid experiencing a turbulent flow that enhances its heat transfer capability. This, in turn, renders the heat pipe action of the heat pipe coolant in the sealed chamber more efficient.

In different embodiments, the second anode portion may be stationary relative to the first rotating portion, the second anode portion may rotate at a speed different from the rotation speed of the first anode section or the second anode portion may rotate in a direction different from the rotation direction of the first anode section.

In other embodiments, the sealed chamber may be under vacuum, to minimize the presence of materials in the chamber other than the desired heat pipe coolant. In order to preserve the vacuum, the components of the rotating portion may be connected with o-ring seals between them, or may be brazed together.

The rotating anode portion may have several different components. A shaft may be connected to a ring of target material upon which an electron beam is incident, and to a condenser that is in contact with the heat pipe coolant and the cooling fluid. The ring may be part of a cup that, together with the shaft and the condenser, encloses the sealed chamber. The condenser may also take different forms. In one embodiment, the condenser has fins that extend into the sealed chamber. Such condenser fins may be distributed about the condenser circumferentially at a plurality of longitudinal positions relative to an axis about which the rotating portion rotates. The fins themselves may be tapered, and may include a plurality of radially extending portions at each of the longitudinal positions. In other variations, the anode may include a fill port with a re-closable seal, via which the sealed chamber may be filled with coolant. An adjustable balancing mass may also be provided that may be used for balancing the anode in two planes.

BRIEF DESCRIPTION OF THE DRAWINGS

The above and further advantages of the invention may be better understood by referring to the following description in conjunction with the accompanying drawings in which.

DETAILED DESCRIPTION

Figure 1:
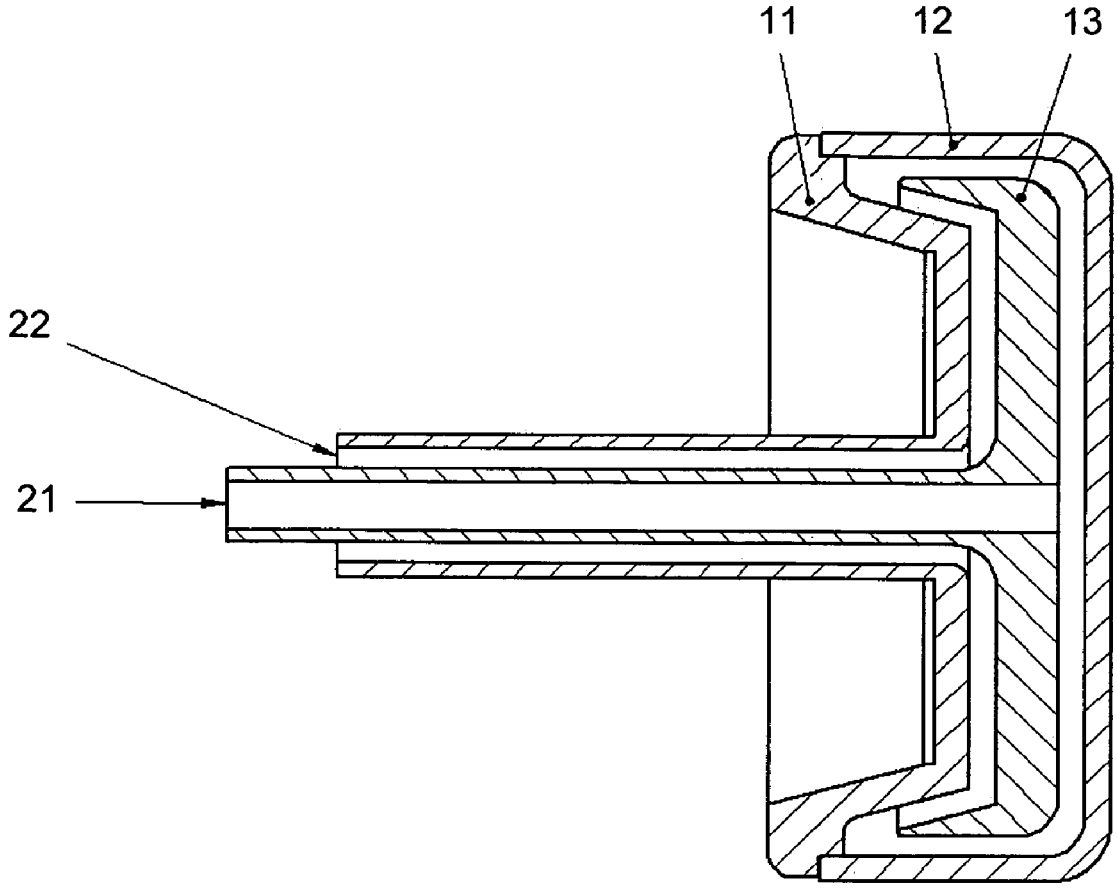
FIGURE 1 (PRIOR ART)
FIG. 1 is a schematic, cross-sectional view of a conventional, rotating X-ray anode.
Figure 2:
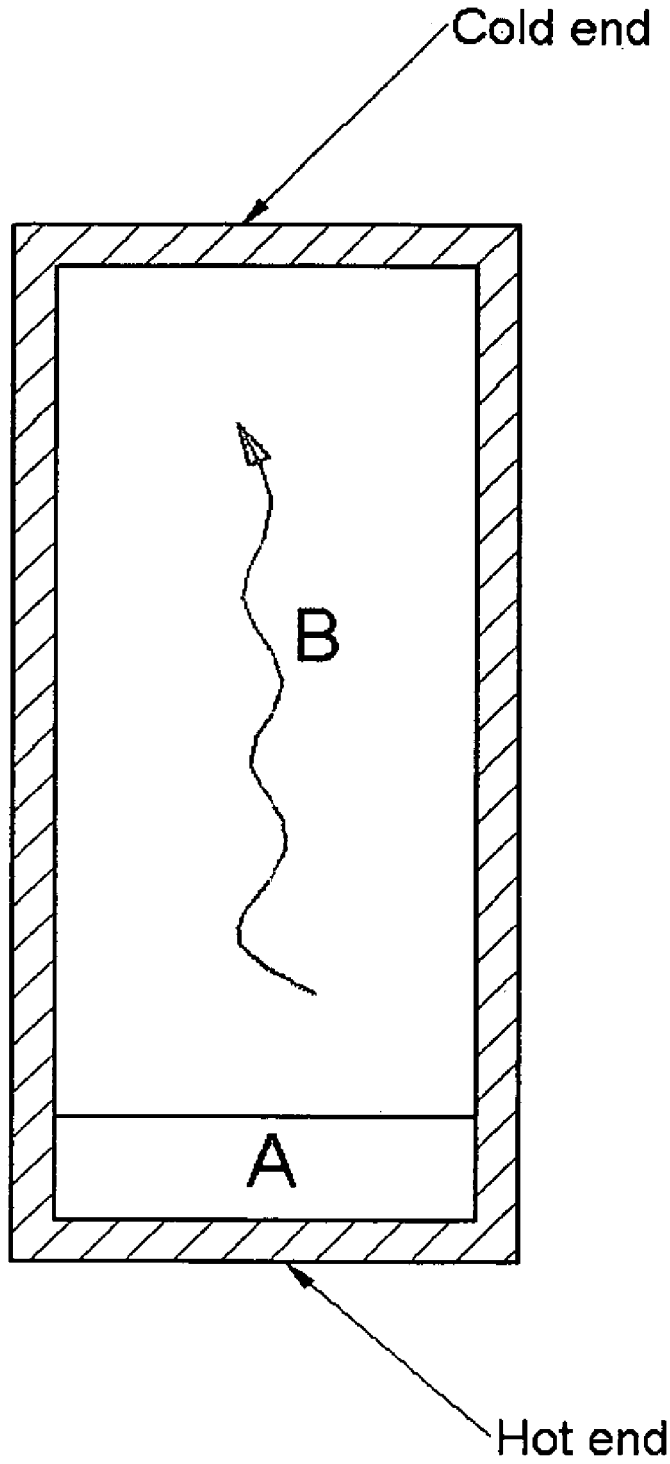
FIGURE 2 (PRIOR ART)
FIG. 2 is a diagram of the general principle of a conventional heat pipe.
Figure 3:
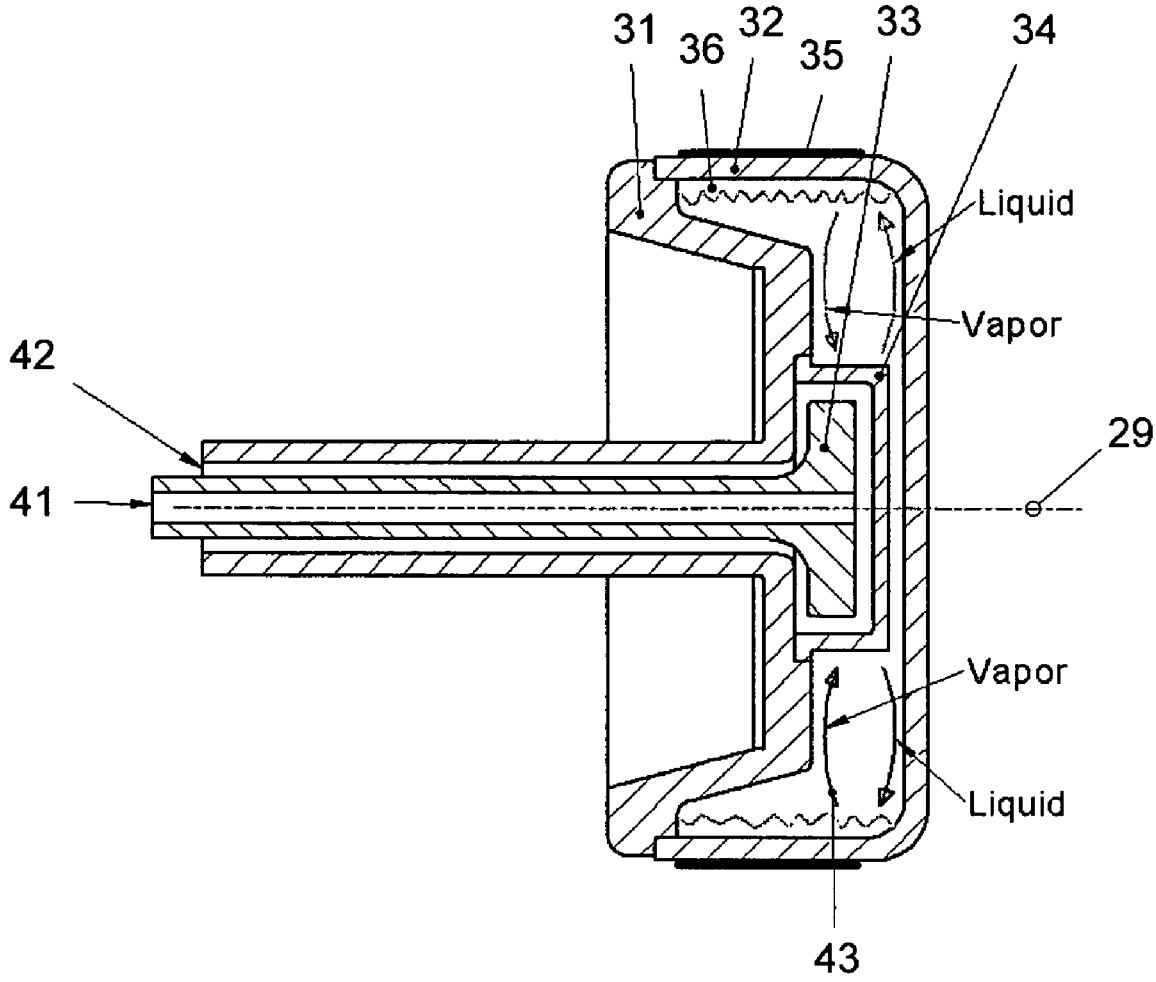
FIG. 3 is a schematic, cross-sectional view of a rotating heat pipe X-ray anode according to the present invention.

Shown in FIG. 3 is a rotatable x-ray anode based on a heat pipe type cooling principle. A shaft 31, condenser 34 and cup 32 form the rotating portion of the anode, which rotates about axis 29. In one embodiment, a distributor 33 is stationary relative to the rotating portion. Alternatively, the distributor may also rotate at a different speed or direction from the speed and direction of rotation of the rotating portion. A cooling fluid is introduced via inlet 41, and passes through the center of the distributor, coming into thermal contact with the condenser 34 before exiting via outlet 42. The external fluid circuit is not shown in FIG. 3, but such features are well known in the art. Those skilled in the art will recognize that the fluid circuit could also function with the fluid flowing in the opposite direction.

The anode cup 32, the shaft 31 and the condenser 34 together form a closed chamber 43 that is filled with a heat pipe coolant 36. The cup 32 includes a ring 35 along the periphery of the cup 32 that is made of a desired target material for generating characteristic X-ray energy in response to an incident electron beam. In this embodiment, the entire cup is made from the same material as the ring, but portions of the cup other than the ring may be made of different material instead. The incident power load from the electron beam directed toward the cup 32 causes a portion of the heat pipe coolant to evaporate within the sealed chamber. The resulting vapor is forced towards the rotation axis 29 by buoyancy forces. The vapor condenses on condenser 34, and the condensate returns to the hot region of the cup via centripetal force.

The heat pipe anode arrangement allows a much thinner layer of coolant to be used as compared to a design in which coolant flows into and out of the interior of the cup chamber. In such a case, the foregoing pressure equation may be simplified to read:

$$P=\rho_c\omega^2R_1\delta$$

where $\delta=R_1-R_0$ (i.e., the thickness of the fluid layer). Using water as a coolant within the anode chamber, typical values for this arrangement might be:

$$\rho_c=1000\ \text{kg/m}^3;\ \omega=628\ \text{rad/s};\ R_1=0.045\ m;\ \delta=0.0002\ m;\ \text{and}\ P=0.04\ \text{bar}$$

$\delta$ is rather small, and although there is a vapor pressure within the anode chamber, the internal pressure is much less as compared to a conventional, water-cooled anode. In addition, the condenser is relatively small, and the pressure needed for pumping the cooling fluid through the fluid circuit on the outside of the chamber is relatively low.

In the embodiment of FIG. 3, the use of a stationary distributor adjacent to the rotating portion of the anode has an effect on the coolant that flows through the pathway between these components. In particular, the relative rotation of the two parts creates a high degree of turbulence in the moving fluid. This turbulence significantly increases the efficiency of the cooling as compared to a fluid path for which there is no turbulence. This, correspondingly, increases the heat load capacity of the anode.

Figure 4A:
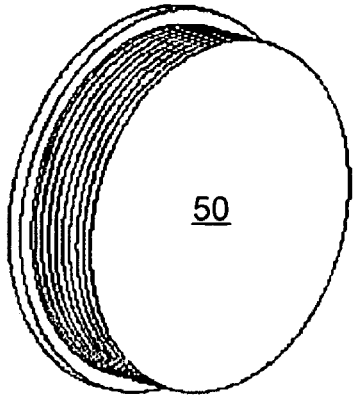
FIGS. 4A and 4B are perspective and cross-sectional views, respectively, of a first cooling fin arrangement that may be used with an anode according to the present invention.
Figure 4B:
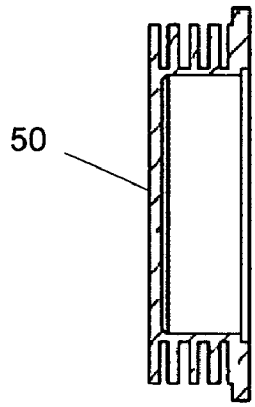

In order to enhance the heat transfer capacity of the condenser, fins integral with the condenser may be provided that create a larger surface area for cooling the vapor. The condenser, and fins, may take any of a number of different forms, and some of these are shown in FIGS. 4A-4F. FIGS. 4A and 4B show a perspective view and cross-sectional view of a condenser that has an end surface 50 and a series of annular fins that extend from the side of the condenser into the vapor chamber. In this embodiment, the fins have a roughly uniform thickness, and the outermost fin is contiguous with the end surface. Those skilled in the art will understand that there may be more fins than are shown in the figure.

Figure 4C:
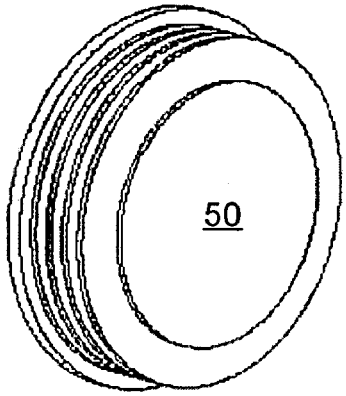
FIGS. 4C and 4D are perspective and cross-sectional views, respectively, of a second cooling fin arrangement that may be used with an anode according to the present invention.
Figure 4D:
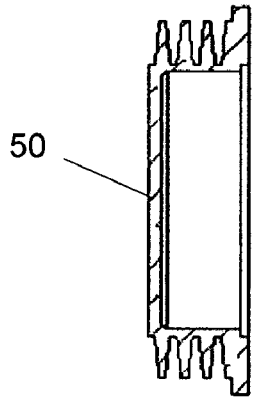

The condenser configuration of FIGS. 4C and 4D is similar to that of FIGS. 4A and 4B, but the fins are tapered so that their thickness narrows toward their outermost edge. This tapering has the effect of improving the thermal conductivity for heat flow towards the axis. In addition, the fin adjacent to the end surface 50 is not contiguous with that surface. Thus, the surface extends a little away from the shaft than the adjacent fin.

Figure 4E:
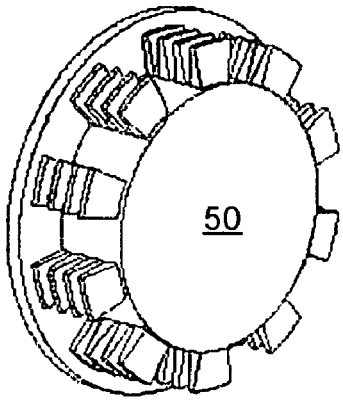
FIG. 4E is a perspective view of a third cooling fin arrangement that may be used with an anode according to the present invention.
Figure 4F:
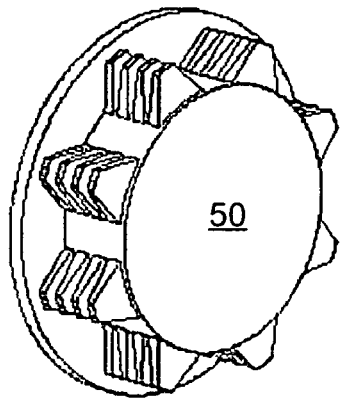
FIG. 4F is a perspective view of a fourth cooling fin arrangement that may be used with an anode according to the present invention.

Two more possible fin configurations are shown, respectively, in FIGS. 4E and 4F. Each of these has fins that are not simply annular, but which have patterns of radially extending portions. In the embodiment of FIG. 4E, the fin portions have a somewhat rectangular profile, and are arrayed circumferentially about the condenser at various axial positions. The fin configuration shown in FIG. 4F is similar, except that the profile of the fin portions is trapezoidal. These different fin profiles may have certain effects on the heat transfer of the condenser, such as creating mechanisms for forming fluid drops or allowing fluid drops to leave the fin surface more easily.

Figure 5:
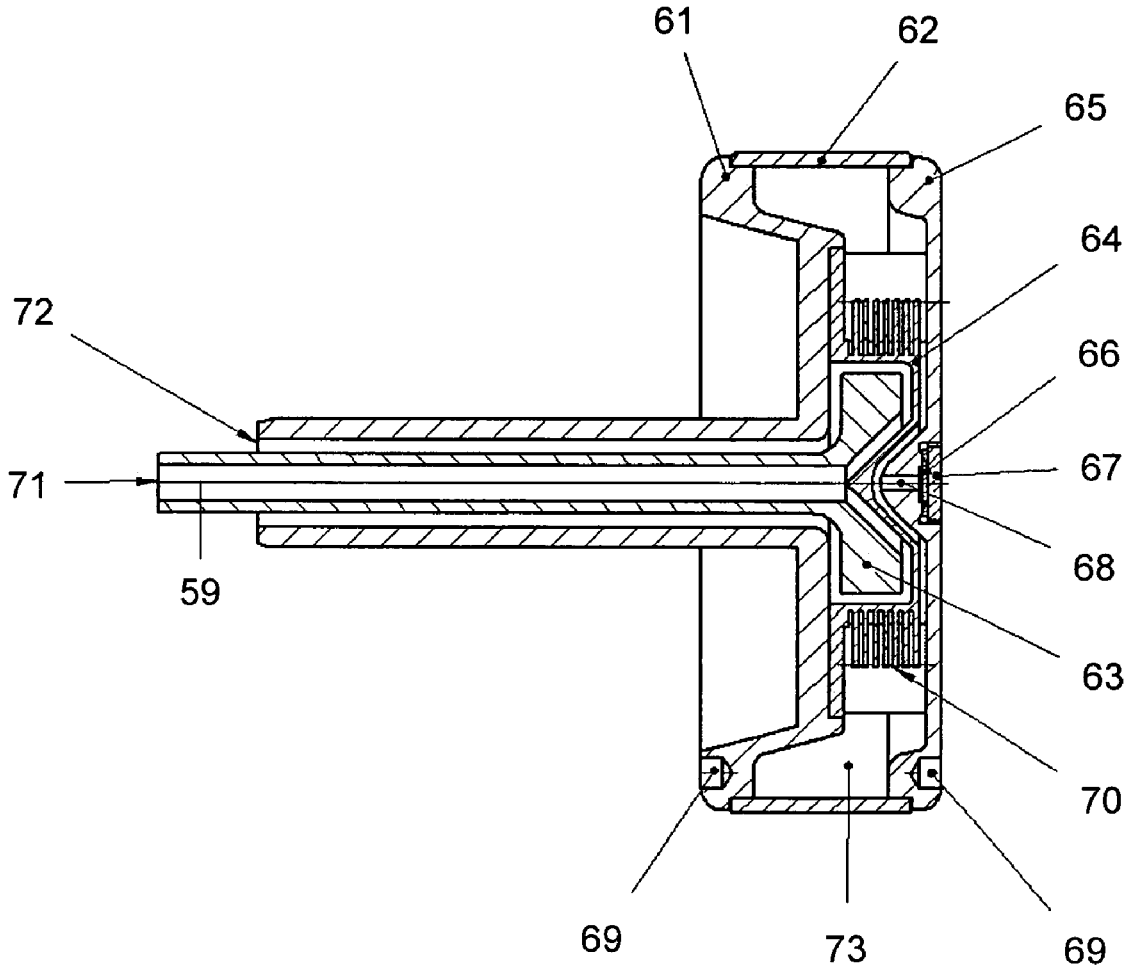
FIG. 5 is a schematic, cross-sectional view of a rotating heat pipe X-ray anode according to the present invention in which cooling fins, a fill port and balancing weights are provided.

Another embodiment of the present invention is shown in FIG. 5. As in FIG. 3, the shaft 61 is part of the rotating portion of the anode, and is rotated about axis 59. A ring 62 of appropriate target material is held between the shaft 61 and a lid 65, and these components together form an inner chamber 73. Within this chamber is located a desired heat pipe coolant for the heat pipe operation. The heat pipe coolant fluid evaporates when in contact with the ring 62, and condenses against condenser 64, after which it returns to the periphery of the chamber 73 under centripetal force. This embodiment, however, also includes a fill port 68 in the lid 65, through which coolant may be introduced to the chamber.

The fill port 68 is located in the center of the lid, and may be closed by a plate 66 and a screw that are used in a "conflat" type configuration. Of course, those skilled in the art will recognize that there are ways to seal the fill port as well, some of which are repeatable, and some of which may be for one-time use. After the introduction of a coolant fluid to the chamber 73, a tool may be used to apply a vacuum to the chamber 73 prior to sealing. The vacuum minimizes the presence of materials other than the desired fluid (or mixture of fluids) in the chamber. As the chamber is under vacuum, all of the connections between the chamber components (e.g., shaft, ring, lid, and condenser) must be vacuum-tight. To provide a good seal, O-ring gaskets may be used between the components. Another possible way of sealing is to braze the components together or, alternatively, to glue them. Brazing is advantageous in that it also provides a mechanical and electrical connection between the parts. Such a connection could also be made by welding.

The condenser 64 of the embodiment of FIG. 5 is also shown as having fins 70 like those discussed above in conjunction with FIGS. 4A-4F. However, those skilled in the art will understand that the fins are not necessary for the fill port embodiment, and that the condenser may be more like that shown in FIG. 3. The FIG. 5 embodiment also shows that the condenser shape may be such as to accommodate the fill port. As shown in the figure, the end surface of the condenser 64 has a concave section adjacent to the fill port 68. This provides space for additional material on the inner surface of the lid, space which may be used to accommodate the fill port and plug 67 that seals the port.

Figure 6:
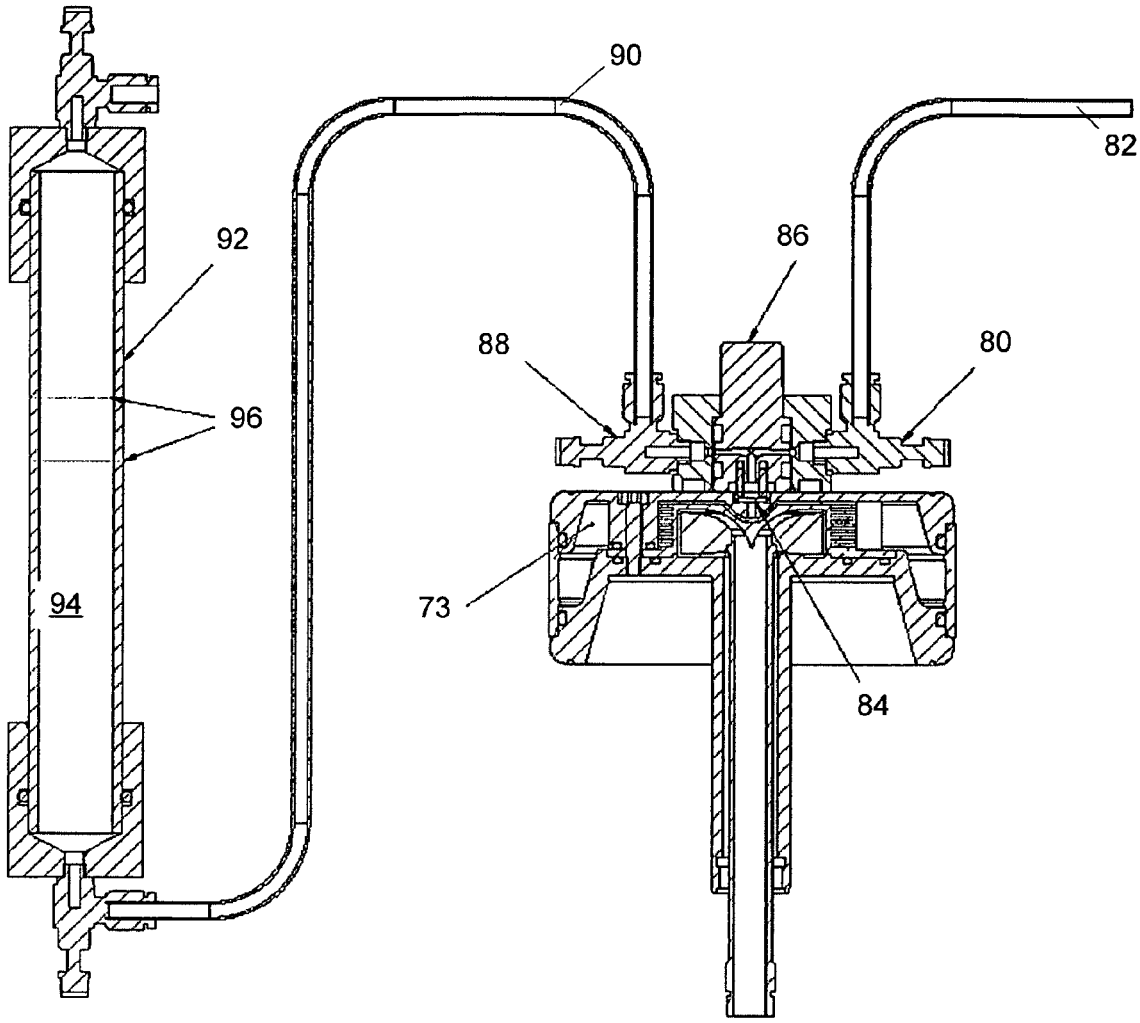
FIG. 6 is a schematic, cross-sectional view of an anode and a filling apparatus according to the present invention.

To fill the chamber 73 of the anode, a filling apparatus is used that includes a first valve 80 connected to a conduit 82, as shown in FIG. 6. The conduit 82 is, in turn, connected a vacuum pump (not shown) that is used to draw a vacuum in the conduit 82. The chamber 73 may be opened by rotation of closure mechanism 84 using wrench 86. The filling apparatus maintains a seal around the periphery of the chamber opening, allowing communication only with the two valves of the filling apparatus. Once the chamber is open, valve 80 may be opened while the vacuum pump is drawing a vacuum. This results in the vacuum being communicated to the chamber 73. The valve 80 is then closed with the chamber 73 remaining in an evacuated state.

Once the valve 80 is closed, valve 88, which was previously closed, may be opened. Valve 88 is in fluid communication with conduit 90, which is connected to vessel 92, which containing the desired cooling fluid 94. The particular cooling fluid may be chosen as desired, an example being methanol. Since the chamber 73 was previously evacuated, the opening of the valve 88 results in a flow of the coolant from the vessel 92, through the conduit 90 and into the chamber 73. If desired, the vessel may be transparent and may have indicators 96 on its surface to indicate the fluid level change in the vessel 92. Once the desired amount of fluid has flowed into the chamber 73, the wrench 86 may be rotated to close the chamber 73 via closure mechanism 84. As mentioned above, the closure mechanism 84 may be a "conflat" type device or O-ring type seal, although other closure mechanisms may also be used.

Also shown in the embodiment of FIG. 5 is a mass 69 that may be used for balancing the anode in two planes. In order to ensure a smooth rotation of the shaft 61, ring 62 and cap 65, it is helpful if the mass distribution of the components is symmetrical about the axis 59. The addition of a mass 69 can be used to counter any imbalance in the other components. A range of different masses may be provided to allow a user more precise control over the balancing. Other ways of balancing may also be used, such as applying a mass to preformed spaces in the shaft or lid, such as by using threaded holes. Balancing can also be performed by removing mass, for example, by drilling or other means.

While the invention has been shown and described with reference to a preferred embodiment thereof, it will be recognized by those skilled in the art that various changes in form and detail may be made herein without departing from the spirit and scope of the invention as defined by the appended claims.

What is claimed is:

1. A rotating anode for an x-ray generator, the anode comprising:

a first portion that includes a target region that emits x-ray radiation in response to an electron beam incident thereupon;

a second portion positioned so that relative rotation occurs between the first and second portions;

a fluid path formed by the first and second portions through which path flows a cooling liquid in contact with both the first and second portions such that the relative rotation between the first and second portions causes turbulence in the cooling liquid;

a sealed chamber within the first portion that is in thermal communication with the target region and with the fluid path between the first and second portions; and a heat pipe coolant that resides within the sealed chamber and that evaporates in response to heat absorbed from the target region and condenses in response to heat lost to the fluid path.

2. The anode of claim 1 wherein the first portion rotates and the second portion is stationary.

3. The anode of claim 1 wherein both the first and the second portion rotate and the first portion rotates at a speed different from a speed at which the second portion rotates.

4. The anode of claim 1 wherein both the first and the second portion rotate and the first portion rotates in a direction different from a direction in which the second portion rotates.

5. The anode of claim 1 wherein the sealed chamber is under vacuum.

6. The anode of claim 1 wherein the first portion comprises a shaft and a ring connected to the shaft, the ring comprising a characteristic X-ray emitting material.

7. The anode of claim 6 wherein the first portion further comprises a condenser that is fixed in position relative to the shaft and that is in thermal contact with the heat pipe coolant and the cooling liquid.

8. The anode of claim 7 wherein the condenser comprises fins that extend into the sealed chamber.

9. The anode of claim 8 wherein the condenser fins are tapered.

10. The anode of claim 8 wherein the first portion rotates about an axis and the condenser fins are distributed about the condenser circumferentially at a plurality of longitudinal positions relative to the axis.

11. The anode of claim 10 wherein the condenser fins include a plurality of radially extending portions at each of said longitudinal positions.

12. The anode of claim 7 wherein the ring and the condenser are each sealed to the shaft by brazing.

13. The anode of claim 7 wherein the ring is an integral part of a cup that, together with the shaft and the condenser, encloses the sealed chamber.

14. The anode of claim 1 further comprising a closable fill port for filling the sealed chamber with heat pipe coolant.

15. The anode of claim 1 further comprising an adjustable balancing mass for balancing the anode in two planes.

16. An anode for an x-ray generator, the anode comprising:

a rotating portion comprising a shaft, a condenser and a ring that includes a target region that emits x-ray radiation in response to an electron beam incident thereupon;

a second portion positioned inside the rotating portion so that relative rotation occurs between the rotating and second portions;

a fluid path, through which a cooling liquid flows, formed by the second portion and the condenser, the relative rotation between the second portion and the condenser causing turbulence in the cooling fluid;

an evacuated sealed chamber within the rotating portion that is in thermal communication with the ring and with the condenser; and a heat pipe coolant that resides within the sealed chamber and that evaporates in response to heat absorbed from the ring and condenses in response to heat lost to the condenser.

17. A method of generating x-ray energy, the method comprising:

providing an anode having a rotating portion that includes a target region that emits x-ray radiation in response to an electron beam incident thereupon and a second portion being positioned inside the rotating portion so that relative rotation occurs therebetween and so that a fluid path exists therebetween through which a cooling liquid flows, the cooling liquid contacting both the rotating portion and the second portion so that the relative rotation between the rotating portion and the second portion causes turbulence in the cooling fluid;

locating a heat pipe coolant in a sealed chamber within the rotating portion such that the coolant is in thermal communication with the target region and with the fluid path between the rotating portion and the second portion such that the coolant evaporates in response to heat absorbed from the target region and condenses in response to heat lost to the fluid path; and flowing cooling fluid through the fluid path such that the cooling liquid is in contact with the rotating portion and the second portion and undergoes a turbulent flow as a result of relative rotation between the rotating portion and the second portion.

18. The method of claim 17 wherein the step of positioning the second portion relative to the rotating portion comprises mounting the second portion so that it is stationary.

19. The method of claim 17 wherein the step of positioning the second portion relative to the rotating portion comprises rotating the second portion at a speed different from a speed at which the rotating portion rotates.

20. The method of claim 17 wherein the step of positioning the second portion relative to the rotating portion comprises rotating the second portion in a direction different from a direction in which the rotating portion rotates.

21. The method of claim 17 further comprising evacuating the sealed chamber.

22. The method of claim 17 wherein the rotating portion comprises a shaft and a ring connected to the shaft, the ring comprising a characteristic X-ray emitting material.

23. The method of claim 22 wherein the rotating portion further comprises a condenser that is fixed in position relative to the shaft and that is in thermal contact with the coolant and the cooling liquid.

24. The method of claim 23 further comprising providing the condenser with fins that extend into the sealed chamber.

25. The method of claim 22 further comprising joining the ring and the condenser to the shaft by brazing.

26. The method of claim 17 further providing the sealed chamber with a closable fill port for filling the sealed chamber with coolant.

* * * * *